US007228906B2

(12) United States Patent
Snider et al.

(10) Patent No.: US 7,228,906 B2
(45) Date of Patent: Jun. 12, 2007

(54) PROPELLANT IGNITION ASSEMBLY AND PROCESS

(75) Inventors: Philip M. Snider, Houston, TX (US); David S. Wesson, Fort Worth, TX (US)

(73) Assignee: Marathon Oil Company, Houston, TX (US)

( * ) Notice: Subject to any disclaimer, the term of this patent is extended or adjusted under 35 U.S.C. 154(b) by 165 days.

(21) Appl. No.: 10/703,676

(22) Filed: Nov. 8, 2003

(65) Prior Publication Data

US 2005/0109509 A1 May 26, 2005

(51) Int. Cl.
*E21B 43/11* (2006.01)

(52) U.S. Cl. ..... 166/299; 166/63

(58) Field of Classification Search ..... 166/299, 166/63, 311

See application file for complete search history.

(56) References Cited

U.S. PATENT DOCUMENTS 2,959,001 A * 11/1960 Porter ..... 60/256
4,391,337 A * 7/1983 Ford et al. ..... 175/4.6
4,537,255 A * 8/1985 Regalbuto et al. ..... 166/297
4,823,875 A * 4/1989 Hill ..... 166/280.1
4,823,876 A * 4/1989 Mohaupt ..... 166/299
5,355,802 A * 10/1994 Petitjean ..... 102/313
5,598,891 A * 2/1997 Snider et al. ..... 166/308.1
5,930,730 A * 7/1999 Marfurt et al. ..... 702/16
6,263,283 B1 * 7/2001 Snider et al. ..... 702/6
6,336,506 B2 * 1/2002 Wesson ..... 166/308.1
6,817,298 B1 * 11/2004 Zharkov et al. ..... 102/312

* cited by examiner

*Primary Examiner*—William Neuder
*Assistant Examiner*—Nicole A Coy
(74) *Attorney, Agent, or Firm*—Jack E. Ebel

(57) ABSTRACT

Method and apparatus for stimulating a subterranean formation that is penetrated by a well bore in fluid communication with the formation. At least one length of propellant is assembled with at least one shaped explosive charge that is aimed axially along the well bore toward the propellant. Detonation of the explosive charge ignites the propellant and any successive explosive charge positioned in the well bore. Detonation of the successive explosive charge ignites the next successive length of propellant and next successive explosive charge.

22 Claims, 4 Drawing Sheets

PROPELLANT IGNITION ASSEMBLY AND PROCESS

BACKGROUND OF THE INVENTION

1. Field of Invention

The present invention relates to an apparatus and method for stimulating a subterranean formation(s), and more particularly, to such an apparatus and method wherein one or more shaped charges are aimed axially at one or more elongated propellant members that are positioned in a subterranean well penetrating a subterranean formation of interest.

2. Description of Related Art

Individual lengths of relatively large diameter metal tubulars are secured together to form a casing string which is positioned within a subterranean well bore to increase the integrity of the well bore and provide a path for producing fluids to the surface. Conventionally, the casing is cemented to the well bore face and subsequently perforated by detonating shaped explosive charges. These perforations extend through the casing and cement a short distance into the formation. In certain instances, it is desirable to conduct such perforating operations with the pressure in the well being overbalanced with respect to the formation pressure. Under certain overbalanced conditions, the well pressure exceeds the pressure at which the formation will fracture, and therefore, hydraulic fracturing occurs in the vicinity of the perforations. As an example, the perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations.

Gas generating propellants have been utilized in lieu of hydraulic fracturing techniques as a more cost effective manner to create and propagate fractures in a subterranean formation. In accordance with conventional propellant stimulation techniques, a propellant is ignited to pressurize the perforated subterranean interval either simultaneous with or after the perforating step so as to propagate fractures therein. One propellant stimulation tool consists of a cast cylinder of solid rocket propellant having a central ignition system which consists of a detonator cord positioned within a bore formed in the center of the cylinder of propellant. The bore may be provided with a thin walled aluminum or cardboard carrier or tube to assist in insertion of the detonator cord through the bore and the carrier having a plurality of apertures formed therein so that the detonator cord when ignited causes the propellant to ignite initially at each aperture. In this manner, the propellant is caused to burn in controlled, uniform manner.

These propellant stimulation tools require two independent conditions for ignition. The propellant must be subjected to a relatively high pressure, such as at least about 500 psi, and an ignition means must be fired. The ignition means conventionally consists of the detonator cord that in turn is ignited by means of conventional electric or percussion detonators. Often several of these propellant stimulation tools containing detonation cord are connected together in series to cover the length of a subterranean zone to be stimulated. As connected in series, a booster or ballistic transfer is located in a tandem sub that links the detonating cords in the propellant stimulation tools located above and below the tandem sub. This booster or ballistic transfer is needed to amplify the energy generated by the detonating cord at the end of a propellant stimulation tool to the level needed to ignite the detonating cord of the next propellant stimulation tool in the series.

However, these conventional propellant stimulation tools need to be manufactured to close tolerances to permit the detonating cord and boosters to effectively initiate an explosive transfer between tools. Further, the ends of each tool need to be sealed to ensure a fluid tight environment exists around the detonating cord to ensure detonation thereof. Such conventional propellant stimulation tools have relatively high manufacturing and component part costs and require operating personnel to have a relatively high level of skill. Thus, none of these prior art devices which utilized propellants in stimulation tools have provided completely satisfactory results in well bores of varying diameters or a repeatable and reliable propellant burn in a discrete or controlled pattern. In view of this, a need exists for a propellant stimulation tool which eliminates the need for a detonating cord for ignition while providing for more reliable detonation of the propellant, decreased manufacturing and components costs and a decreased level of skill for operating personnel.

SUMMARY OF THE INVENTION

To achieve the foregoing and other objects, and in accordance with the purposes of the present invention, as embodied and broadly described herein, one characterization of the present invention comprises an apparatus for stimulating a subterranean formation. The apparatus has a first tube having at least one hole therein at a position along the length thereof, propellant material positioned on the inside of the tube at least at the position, at least one explosive charge positioned within the interior of the first tube and aimed toward the propellant substantially along the axis of the tube, and a detonator for igniting one explosive charge.

Another characterization of the present invention comprises an apparatus for stimulating a subterranean formation having a generally elongated body of propellant and at least one shaped explosive charge aimed in a substantially axial direction toward the generally elongated body of propellant.

Yet another characterization of the present invention comprises a method of stimulating a subterranean formation which is penetrated by a well bore in fluid communication with the formation. The method includes positioning propellant within a subterranean well bore in proximity to a subterranean formation, and detonating at least one shaped explosive charge which is aimed axially along the well bore thereby igniting the propellant.

A further characterization of the present invention is a method of generating a seismic source in a subterranean well bore comprising positioning propellant within a subterranean well bore and detonating at least one shaped explosive charge which is aimed axially along the well bore thereby igniting the propellant and creating a seismic source.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DESCRIPTION OF THE PREFERRED EMBODIMENTS

Figure 1:
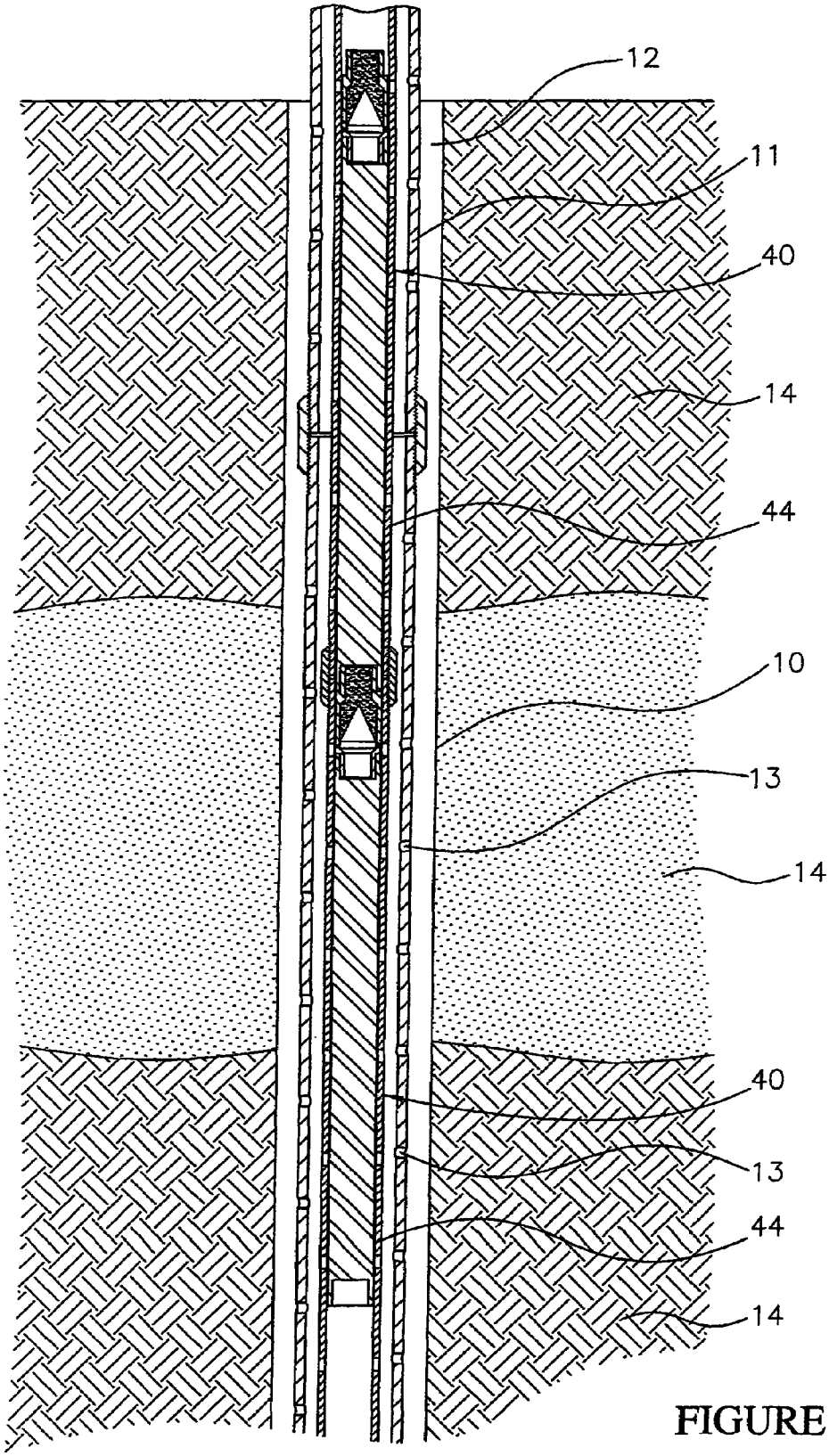
FIG. 1 is a cross sectional view of the apparatus of one embodiment of the present invention as positioned within a well penetrating a subterranean formation.

As illustrated in FIG. 1, a well 10 having a casing 11 which is secured therein by means of cement 12 extends from the surface of the earth at least into a subterranean formation or zone of interest 14. Casing 12 is illustrated in FIG. 1 as having one or more perforations 13 therethrough. One or more propellant apparatus 40 of the present invention are positioned in the well by any conventional means, such as be tubing or wireline as will be evident to a skilled artisan. Any suitable means, such as a packer and tubing (not illustrated), may be employed to isolate the portion of well 10 adjacent interval 16, if desired.

Figure 1A:
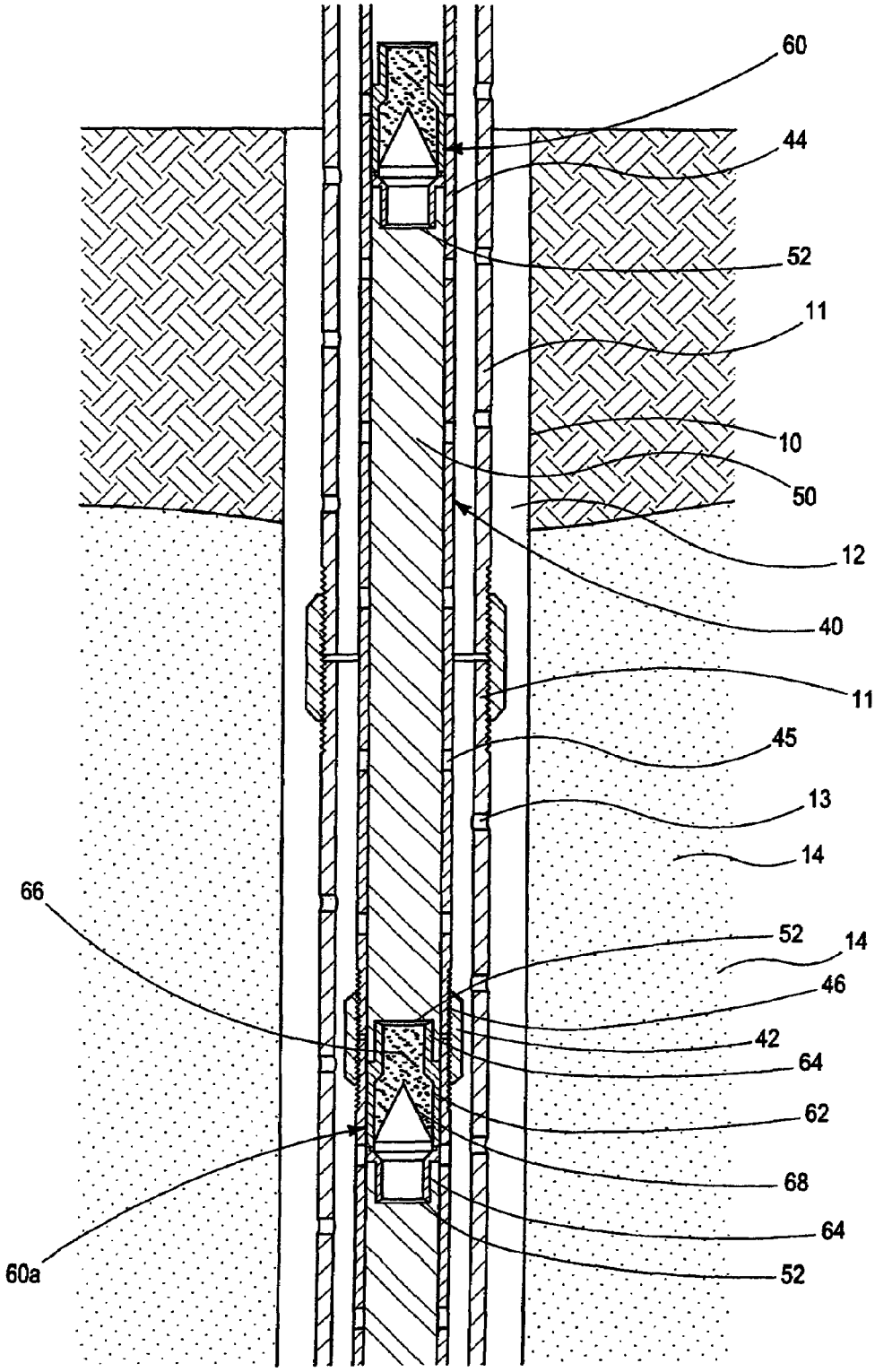
FIG. 1*a* is a partially cutaway, cross sectional expanded view of the embodiment of the present invention illustrated in FIG. 1.

Referring to FIGS. 1 and 1*a*, two propellant apparatus 40 of the present invention are illustrated as secured together by any suitable means, such as by a coupling 42. Each apparatus 40 comprises a hollow carrier 44 having a substantially axial bore therethrough and having one or more apertures, holes or vents 45 through the side wall thereof. Where carrier 44 is provided with a plurality of hole(s) 45, these holes may be either uniformly or randomly spaced about the periphery of carrier 44 and may either extend along a portion of or along substantially the entire length of carrier 44. Hole(s) 45 can be formed to have any other suitable cross sectional configuration, as will be evident to a skilled artisan. Carrier 44 is preferably formed of metal, such as a high-grade steel. Each end of carrier 44 is provided with a suitable means of connection, such as screw threads 46. Carrier 44 may be bowed or constricted at one or more locations along the length thereof, although carrier 44 is preferably substantially straight as illustrated in FIGS. 1 and 1*a*. And although carrier 44 preferably has a substantially round cross sectional configuration, carrier 44 may also have any other cross sectional configuration, for example square, oval etc., that may be desired for a given subterranean well bore and/or application as will be evident to a skilled artisan.

A propellant member 50 is positioned within the generally axially bore through hollow carrier 44 by any suitable means. For example, propellant member 50 may be molded prior to insertion within carrier 44 or may be formed by using carrier 44 as a mold. Preferably, epoxy or plastic propellant which has an oxidizer incorporated therein is poured or injected into a mold (not illustrated) which is positioned within carrier 44 at a suitable location at the surface of the earth in a manner as will be evident to a skilled artisan. A suitable mold may be positioned around carrier 44 and sized to permit propellant from extending into aperture(s) 45. In this manner, propellant 50 extends into aperture(s) 45 but terminates substantially at the outer diameter of carrier 44 as illustrated in FIGS. 1 and 1*a*. Propellant member 50 is allowed to cure at ambient or elevated temperature so as solidify. As also illustrated in FIG. 1, propellant member 50 is formed with a recess 52 at each end thereof to accommodate a shaped charge in a manner hereinafter described. And although illustrated as being of unitary construction, propellant 50 may be formed of multiple sections.

Propellant member 50 may extend along the entire length of carrier 44 or a portion thereof, may extend about the entire diameter of carrier 44 or only a portion thereof, and preferably is positioned so as to cover at least a portion of at least one hole 45. Although illustrated in FIGS. 1 and 1*a* as being elongated and generally cylindrical in configuration, propellant member 50 may have other suitable configurations, for example spiral, one or more linear or curved strips, star shaped, etc. Propellant 50 is a water repellant or water proof propellant material which is not physically effected by hydrostatic pressures commonly observed in a subterranean well bore during completion or production operations and is unreactive or inert to almost all fluids, in particular those fluids encountered in a subterranean well bore. Preferably, the propellant is a cured epoxy or plastic having an oxidizer incorporated therein such as that commercially available from HTH Technical Services, Inc. of Coeur d'Alene, Idaho and Owen Oil Tools, Inc. of Fort Worth, Tex. This propellant requires two independent conditions for ignition. The propellant must be subjected to a relatively high pressure, such as at least about 500 psi, and an ignition means must be fired.

In accordance with the present invention, an ignition means is provided in the form of a shaped charge 60 which is positioned at one or both of the ends of each propellant 50. Each shaped charge 60 has a housing 62 having reduced diameter end portions 64 which are configured and sized to mate with recess 52 of propellant 50. One portion of the housing is filled with an explosive 66 and a generally conical liner 68 that is configured to concentrate the energy of the charge upon detonation in a generally axial direction. As illustrated in FIGS. 1 and 1*a*, each shaped charge is aimed in the same axial direction. In operation, one or more apparatus 40 of the present invention that are secured together by means of a coupling 44 are lowered into well 10 by any conventional means, such as wireline or tubing, to position apparatus 40 adjacent the subterranean formation or zone of interest 14. Carrier(s) 44 provide sufficient rigidity and internal structural integrity to apparatus 40 to ensure effective placement of the apparatus within a subterranean well bore, especially small diameter, deviated, and/or high temperature well bores, while inhibiting damage. Each shaped charge 60 has one end 64 thereof mated within a recess 52 in one end of propellant member and in the embodiment illustrated in FIGS. 1 and 1*a*, each shaped charge 40 is aimed at the propellant 50 in the same axial direction. Once positioned in the well, the initial shaped charge 60 is detonated by means of a conventional percussive or electrical detonator as will be evident to a skilled artisan. Upon ignition, the shaped charged which is aimed axially at a propellant 50 shoots through the propellant member 50 and strikes the next shaped charge 60 a thereby igniting shaped charge 60*a*. In this manner, the ignition of the initial shaped charge successively ignites all shaped charges where multiple apparatus 40 are secured together in series as discussed above.

The temperature and pressure resulting from the ignition of the each shaped charge 60 ignites the propellant 50. Pressurized gas generated from the burning of propellant 50 enters formation 14 through perforations 13 formed in casing 11 thereby cleaning such perforations of debris. These propellant gases also stimulate formation 14 by tending the connectivity of formation 14 with well 10 by means of the pressure of the propellant gases fracturing the formation. Carrier 44 is usually not damaged to any significant extent, and as such, may be removed from the well via wireline 18 or tubing (not illustrated) and be refurbished, if necessary, and reused. Although carrier 44 is preferably constructed of metal, carrier 44 may be constructed of a material which substantially entirely breaks up or decomposes, for example a polyester fiber, epoxy composite, upon ignition of shaped charge 60.

Figure 2A:
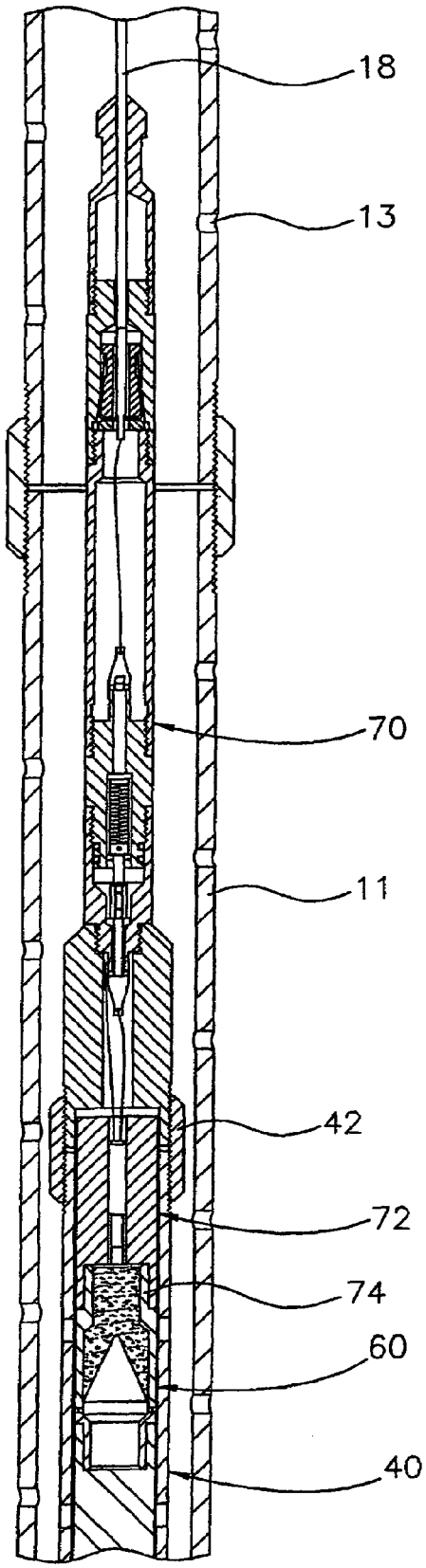
FIGS. 2*a* and *b* are cross sectional views of the apparatus of the present invention as secured to an electrical detonator.
Figure 2B:
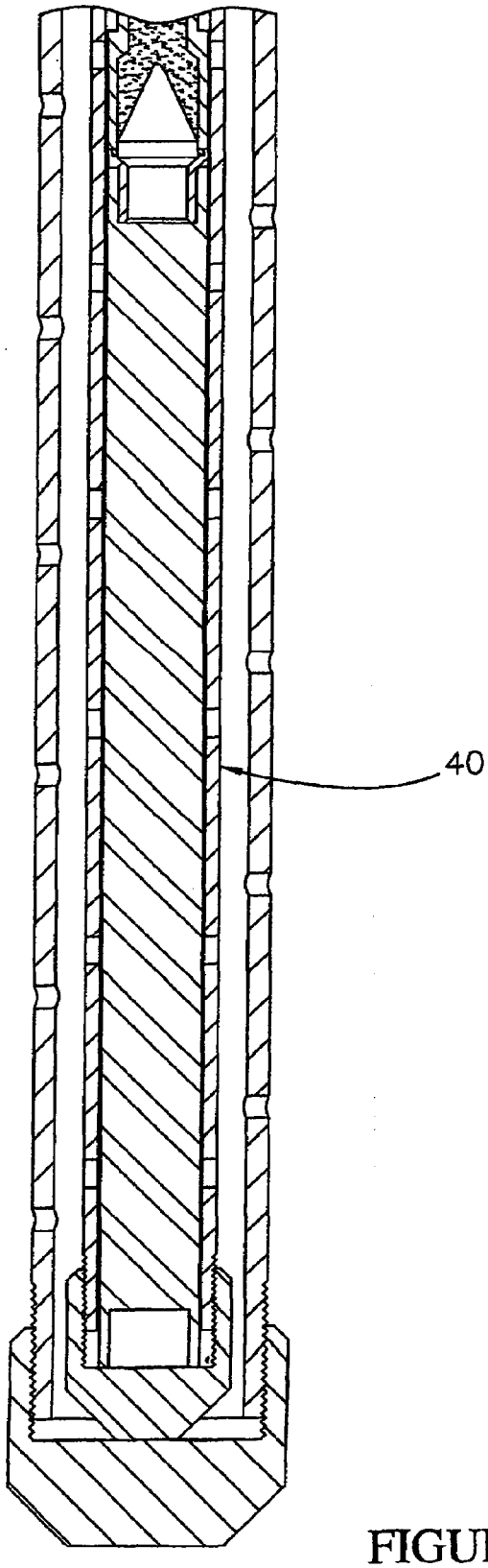

Referring now to FIGS. 2*a* and 2*b*, the apparatus 40 of the present invention is illustrated as being connected to an electrical detonator assembly 70 which in turn is suspended on a wireline 18. Detonator assembly 70 includes a detonator 72 having a recess 74 which is mated with one end member 64 of shaped charge 60. Detonator assembly 70 is secured to apparatus 40 by any suitable means, for example by coupling 42. Wireline 18 extends to the surface of the earth and serves to position apparatus 40 at any desired subterranean location and supply electrical current to detonator 72. As thus assembled and positioned in a subterranean well bore, current is passed from a suitable source at the surface via wireline 18 and to ignite detonator 72 which in turn ignites the shaped charge 60 at the exposed end of apparatus 40.

The propellant apparatus of the present invention can be utilized with tubing or wireline. The increased strength of the tubing over wireline allows the use of a longer propellant apparatus and/or more apparatus to be secured together, thereby permitting a longer interval to be stimulated in a single trip into a well. A tubing-conveyed apparatus is also compatible with the use of packers to isolate one or more portions of the well adjacent one or more intervals of the formation. Thus, the method may be used where it is desired for some other reason to limit the pressure to which another portion of the well is subjected, for example, in a well where one or more other zones have already been completed. Further, if the well has a high deviation angle from vertical or is horizontal, the tubing may be used to push the perforating and propellant apparatus into the well.

Although the method and apparatus of the present invention is disclosed as employed in a cased well that has been perforated to provide fluid communication with a subterranean formation or zone of interest, the method and apparatus of the present invention are equally applicable to an open hole completion of a well bore where casing is not employed, especially where the well bore has been damaged during completion along at least a portion of the subterranean formation or zone of interest. The shaped charge(s) and carriers used in accordance with the present invention may be of any desired length and the distances at the connection between carriers arranged in series can have high tolerances as the shaped charges used in accordance with the present invention can shoot through large fluid gaps and reliably ignite the next carrier. Further, the propellant may be ignited at either end in accordance with the present invention and the apparatus may be conveyed into a subterranean well by any method other than by wireline or tubing conveyed, such as by free falling by gravity through the well.

In lieu of stimulating a subterranean formation or zone, the method and apparatus of the present invention may also be used to generate a seismic source from a downhole location.

While the foregoing preferred embodiments of the invention have been described and shown, it is understood that the alternatives and modifications, such as those suggested and others, may be made thereto and fall within the scope of the invention.

We claim:

1. An apparatus for stimulating a subterranean formation comprising:

a generally elongated body of propellant having a first end, a second end, and a longitudinal axis;

a first shaped explosive charge secured to said first end and aimed in a substantially axial direction along said longitudinal axis at said generally elongated body of propellant; and a second shaped explosive charge secured to said second end and aimed in a substantially axial direction along said longitudinal axis.

2. The apparatus of claim 1 wherein said one and said another of said at least one shaped charge are aimed in the same substantially axial direction.

3. The apparatus of claim 1 wherein said propellant is a cured epoxy or plastic having an oxidizer incorporated therein.

4. A method of stimulating a subterranean formation that is penetrated by a well bore in fluid communication with the formation, said method comprising:

positioning propellant within a subterranean well bore in proximity to a subterranean formation; and detonating at least one shaped explosive charge which is aimed axially along the well bore at said propellant thereby igniting said propellant and detonating a second shaped explosive charge that is aimed axially along said well bore which ignites a second propellant that is positioned within said subterranean well bore.

5. A method of generating a seismic source in a subterranean well bore comprising:

positioning propellant within a subterranean well bore; and detonating at least one shaped explosive charge which is aimed axially along the well bore at said propellant thereby igniting said propellant, detonating a second shaped explosive charge that is aimed axially along said well bore, igniting a second propellant which is positioned within said subterranean well bore, and creating a seismic source.

6. An assembly for stimulating a subterranean formation comprising;

a first apparatus having a first propellant material and a first explosive charge aimed in a substantially axial direction at said first propellant material; and a second apparatus arranged in series with said first apparatus, said second apparatus having a second propellant material and a second explosive charge aimed in a substantially axial direction at said second propellant material.

7. The assembly of claim 6 wherein first apparatus comprises:

a first tube having at least one aperture therein at a position along the length there of, said first propellant material being positioned on the inside of said first tube at least at said position and said first explosive charge being positioned within the interior of said first tube and aimed at said first propellant material substantially along the axis of said first tube; and a detonator for igniting said first explosive charge.

8. The assembly of claim 7 wherein said at least one aperture extends through said first tube.

9. The assembly of claim 8 wherein said first propellant material extends into said at least one aperture.

10. The assembly of claim 8 wherein said first propellant material extends onto the exterior of said first tube.

11. The assembly of claim 7 wherein said at least one aperture has a substantially round configuration.

12. The assembly of claim 7 wherein said first tube is substantially cylindrical in configuration.

13. The assembly of claim 7 wherein said first propellant material does not extend into said at least one aperture.

14. The assembly of claim 13 wherein said first propellant material extends substantially to the outer diameter of said first tube.

15. The assembly of claim 7 wherein said first propellant material is a cured epoxy or plastic having an oxidizer incorporated therein.

16. The assembly of claim 7 wherein said first tube is formed of a material which does not decompose or disintegrate upon detonation of said first propellant material.

17. The assembly of claim 7 wherein said first propellant material is water repellant or water proof, is not physically effected by hydrostatic pressures encountered in a subterranean formation and is unreactive or inert to fluids which may be encountered in a well penetrating and in fluid communication with said subterranean formation.

18. The assembly of claim 17 wherein said first propellant is a cured epoxy or plastic having an oxidizer incorporated therein.

19. The assembly of claim 7 wherein said first tube has a plurality of said apertures therethrough.

20. The assembly of claim 19 wherein said plurality of apertures extend substantially the entire length of said first tube.

21. The assembly of claim 19 wherein said plurality of apertures extend about substantially the entire periphery of said first tube.

22. The assembly of claim 19 wherein said plurality of apertures are arranged in a uniform pattern about said first tube.

* * * * *